United States Patent [19]

Donaldson

[11] 4,307,908

[45] Dec. 29, 1981

[54] BEAD-STRINGING IMPLEMENT AND METHOD OF USE

[76] Inventor: Honora A. Donaldson, 1016 E. 224th St., Bronx, N.Y. 10466

[21] Appl. No.: 190,057

[22] Filed: Sep. 23, 1980

[51] Int. Cl.[3] ..... A47F 13/06

[52] U.S. Cl. ..... 294/1 R; 294/15; 132/46 R

[58] Field of Search ..... 294/1 R, 15, 16, 25, 294/26, 99 R, 99 A; 132/46 R, 46 A, 48 R

[56] References Cited

U.S. PATENT DOCUMENTS 3,228,555 1/1966 Pinto ..... 294/15

4,103,693 8/1978 Reagan ..... 132/46 R

*Primary Examiner*—James B. Marbert

*Attorney, Agent, or Firm*—Philip Sands

[57] ABSTRACT

A bead-stringing implement and a method of utilizing it is disclosed, the implement comprising a handle, and a loop secured to one end of the handle. The loop is flexible with sufficient rigidity to self-maintain a prescribed open configuration. In addition, the loop is constituted such that when it is diametrally squeezed in a direction normal or perpendicular to the handle the loop presents a pair of contiguous or interconnected engageable limbs having a coextensive elongate length of sufficient magnitude axially of the handle for (a) penetrating an opening of a generally annular bead to thereby carry the bead in juxtaposition with the handle and (b) projecting beyond the axial extent of the bead to thereby present a loop-opening of reduced magnitude for receiving a cluster of braided hair in juxtaposition with and normal or perpendicular to the axial extent of the bead.

1 Claim, 6 Drawing Figures

Fig. 1.
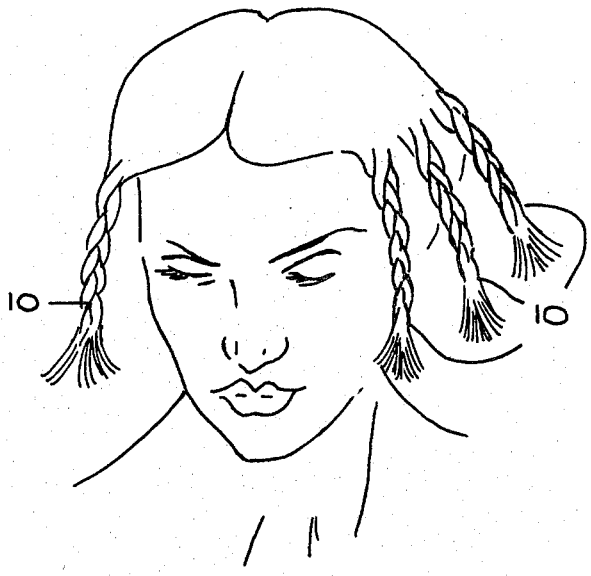
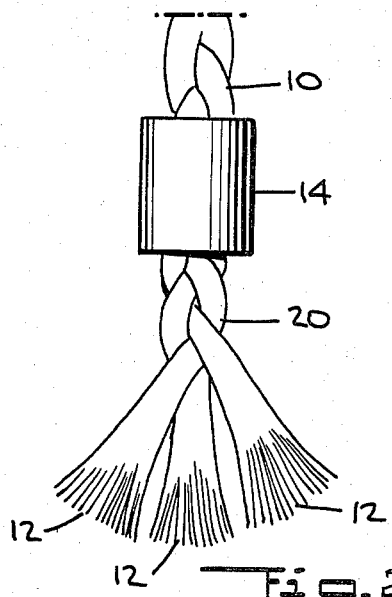
Fig. 2.
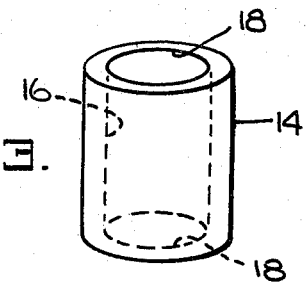
Fig. 3.
Fig. 4.
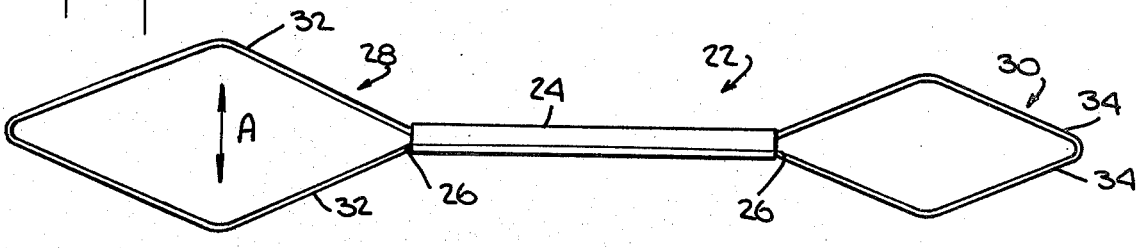
Fig. 5.
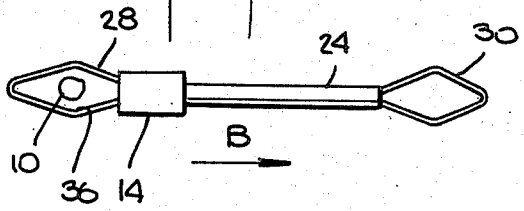
Fig. 6.
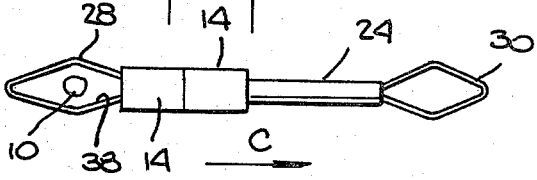

BEAD-STRINGING IMPLEMENT AND METHOD OF USE

BACKGROUND OF THE INVENTION

The present invention relates generally to hair-styling accessories, and more particularly to an implement for stringing a number of beads in succession to braided hair, as well as to a method of so stringing the beads to the braided hair.

Recently, it has become fashionable to string beads to braided hair. In this regard individuals have adopted hair styles popularized by movie actors and actresses, such as the hair style in which hair is braided in clusters, and annular beads are slipped in succession onto each braided cluster of hair. Not only is a hairstyle of this nature time consuming to create, but because of the difficulty of applying to the braided hair clusters the beads in abutment against one another to form a train of beads on each cluster, there is often required assistance from another individual to perform the bead application process. The assistance is required simply because the individuals having their hair so styled cannot see behind them to apply the beads. As the opening in each of the beads is small, and it is difficult to push the end of each cluster of braided hair through the bead openings, it is often beyond the capability of the individual whose hair is being so styled to apply the beads themselves without assistance. Even when an individual is so capable, a complex arrangement of angled mirrors or other visibility-assisting accessories is necessary, and all too often is unavailable.

SUMMARY OF THE INVENTION

It is an object of the present invention, therefore, to eliminate the need for assistance from a second individual to perform the bead application process. It is another object of the present invention to permit the individual having his or her hair so styled to perform the bead application process not merely by himself or herself but also rapidly without the need for a complex arrangement of mirrors or other visibility-assisting accessories.

It is still a further object of the present invention to provide an implement for stringing beads to clusters of braided hair rapidly without the need to otherwise "push" the ends of each braided cluster of hair through the beads. Pushing the ends of each braided cluster of hair through a bead, as may well be expected, has the attendant disadvantage in that the cluster ends do not remain tightly contracted, and when so attempting to push these ends through the bead openings the ends tend to separate leaving hair strands diverging beyond the span of each bead opening. The divergency of the strands makes it all the more difficult to apply the beads rapidly and efficiently, as the loose strands not only interfere with slipping on the beads, but also are caused often to further separate from the remaining braid thereby tending to weaken or loosen the entirety of the remaining braid.

In view of the foregoing, the present invention may be characterized as a bead-stringing implement and a method of utilizing it, the implement comprising a handle, and a loop secured to one end of the handle. The loop is flexible with sufficient rigidity to self-maintain a prescribed open configuration. In addition, the loop is constituted such that when it is diametrally squeezed in a direction normal or perpendicular to the handle the loop presents a pair of contiguous or interconnected engageable limbs having a coextensive elongate length of sufficient magnitude axially of the handle for (a) penetrating an opening of a generally annular bead to thereby carry the bead in juxtaposition with the handle and (b) projecting beyond the axial extent of the bead to thereby present a loop-opening of reduced magnitude for receiving a cluster of braided hair in juxtaposition with and normal or perpendicular to the axial extent of the bead.

BRIEF DESCRIPTION OF THE DRAWINGS

The above and additional objects and advantages of the present invention will be more clearly understood from the following detailed description thereof when read in conjunction with the accompanying drawings, in which:

FIG. 1 is a sketch of a head of an individual whose hair is braided in clusters preparatory for applying a train of beads to each cluster;

FIG. 2 is an enlarged fragmentary view of a single cluster of braided hair on which is present a bead;

FIG. 3 is an enlarged perspective view, partly in phantom, illustrating a bead for application to a cluster of braided hair;

FIG. 4 is a plan view illustrating the present invention;

FIG. 5 is a plan view of the present invention, in reduced size, carrying a single bead for application to a cluster of braided hair; and FIG. 6 is a view similar to FIG. 5, but illustrating a pair of beads in juxtaposition with one another preparatory for being applied to a cluster of braided hair.

DETAILED DESCRIPTION OF INVENTION

Referring now to the drawings, and more particularly to FIGS. 1 through 3, there is illustrated in FIG. 1 the head of an individual having a hairstyle in the form of clusters of braided hair. Each cluster is identified generally by the reference character 10. This hairstyle is often referred to by the term "corn rows." FIG. 2 illustrates an enlarged view of a single cluster of braided hair composed of a number of sub-clusters of hair 12 interwoven with one another. On the cluster of hair 10 in FIG. 2, there is also illustrated a generally annular bead 14 having been applied thereto by the implement and method of the present invention, as will be discussed below. The annular bead 14 may have any exterior shape that is, for example, cylindrical, spherical, or otherwise. However, the bead 14, as illustrated in FIG. 3, must be provided with an internal channel or opening 16 that extends entirely axially through the central portion of the bead 14 and presents a pair of opposite open ends 18.

The conventional manner for applying or slipping the bead 14 onto each cluster of hair 10 is to push one open end 18 of the bead 14 onto the end 20 (FIG. 2) of each cluster of hair 10. Because of the generally lose condition of the individual hair strands of each sub-cluster 12 of hair at the end 20 of each braided cluster 10, it is quite difficult to so push the bead 14 onto the cluster 10. The present invention, among other things, overcomes this difficulty.

Referring now to FIG. 4, there is illustrated the implement of the present invention generally denoted by reference character 22. The implement 22 includes an elongate handle 24 to which is connected at each end 26, respectively, a loop 28 and a loop 30. The loop 28 is preferably larger in magnitude than the loop 30 and is made of a flexible material. The flexible material may be that of plastic or metal wiring, and is sufficiently rigid to self-maintain a prescribed open configuration, for example, in the form of a diamond or elongate oval. Preferably, the entire implement 22, that is, the handle 24 and the loops 28 and 30, is constituted of a single flexible plastic material molded by conventional means.

The flexible nature of the loops 28 and 30 is such that the loop 28 may be squeezed diametrally in the direction of arrow 'A', normally or perpendicular to the length of the handle 24, to present a pair of interconnected or contiguous, engageable limbs 32. Similarly, the loop 30 is so constituted of a pair of interconnected or contiguous, engageable limbs 34.

Preferably, the loops 28 and 30, when diametrally squeezed, present the limbs 32 and 34 with an elongate length, in a direction of the axis of the handle 24, that is greater than the length or axial extent of the bead 14 between the ends 18 of the latter. As such, the bead 14 may be slipped either onto the loop 28 or the loop 30 simply by squeezing the limbs 32 (or 34) diametrally, and inserting them into the opening 16 of the bead 14. In this manner, the bead 14 may be moved into juxtaposition with the handle 24 of the implement 22 and either slightly overlap it or remain substantially in abutment against it.

Moreover, the elongate length of the limbs 32 and 34 of the loops 28 and 30, respectively, is such that not only will the loops 28 and 30 carry the bead 14 in juxtaposition with the handle 24, but also the loops 32 and 34 will project beyond the axial extent of the bead 14 and thereby present a loop-opening of reduced magnitude, for example, as denoted in FIGS. 5 and 6 by reference character 36 and 38, respectively.

In this regard, as illustrated in FIGS. 5, 6 the present invention is utilized by slipping on a bead 14 (FIG. 5) or two beads 14 (FIG. 6) onto the loop 28 into juxtaposition with the handle 24. In each instance, there remains a loop-opening of reduced magnitude, denoted by reference characters 36 or 38. Because of the nature of the flexibility of the loops 28 and 30 to self-maintain an open configuration (that is, a configuration in which the limbs 32 of the loop 28 tend to separate from one another, or the limbs 34 of the loop 30 tend to separate from one another), a cluster of braided hair 10 can be inserted into the loop-openings 36 or 38 normally of the axial extent of the bead 14 (FIG. 5) or beads 14 (FIG. 6). The handle 24 of the implement 22 can then be gripped with the thumb and forefinger of one hand of a user while the bead 14 (or beads 14) may be gripped with the thumb and forefinger of the other hand of the user. Once so gripped, the implement 22 can be moved in the direction of arrow 'B' (FIG. 5) or arrow 'C' (FIG. 6) to be withdrawn from the bead 14 (or beads 14). The withdrawal of the implement 22 from the bead 14 (or beads 14) "pulls" the braided hair cluster 10 through the bead 14 (or beads 14) in a singular motion. In this manner, one or more beads in the singular motion is slipped onto the braided hair cluster 10 without interference or difficulty.

As may well be expected, the implement pursuant to the present invention may be utilized simply by "feel" without mirrors or other visibility-assisting accessories, or the need for assistance from another individual. Consequently, the hairstyle of braided hair clusters of the "corn-rows" variety can now be effected easily and more desirably. The benefit reaped by the present invention, therefore, is significant.

Having set forth the nature of the present invention, it will be understood that other forms, variations or modifications of it may come to mind. All such other forms, alterations, or modifications of the present invention are contemplated herein if encompassed by the scope of the appended claims.

What is claimed is:

1. A method of stringing a plurality of generally annular beads to a cluster of braided hair, said method comprising:

(a) providing a plurality of generally annular beads each having an axial opening extending entirely therethrough;

(b) providing a bead-stringing implement including a handle, and loop means secured to one end of said handle, said loop means being flexible yet of sufficient regidity to self-maintain a prescribed open configuration, said loop means being constituted such that when it is squeezed in a direction normal to said handle said loop means presents a pair of interconnected engageable limbs having a coextensive elongate length that is greater than the axial extent of any of said beads, said elongate length of said limbs of said loop being of sufficient magnitude to (i) penetrate the axial opening of at least any one of said beads and thereby carry at least the latter said bead in juxtaposition with said handle and (ii) project beyond the axial extent of at least the latter said bead and thereby present a loop-opening of reduced magnitude for receiving a cluster of braided hair in juxtaposition with and normal to the axial extent of at least the latter said bead;

(c) squeezing and inserting said limbs of said loop means through the axial opening of at least the latter said bead to carry the latter in juxtaposition with said handle;

(d) inserting an end portion of said cluster of braided hair through said loop-opening of reduced magnitude in juxtaposition with the latter said bead;

(e) withdrawing said loop means from the axial opening of the latter said bead and thereby pull said end portion of said cluster of braided hair entirely through the axial opening of the latter said bead; and (f) repeating steps (c) through (e) with additional ones of said beads.

* * * * *